US006607090B1

(12) United States Patent
Doerr

(10) Patent No.: US 6,607,090 B1
(45) Date of Patent: Aug. 19, 2003

(54) FLOATING BEVERAGE HOLDER

(76) Inventor: Stephen Doerr, 13265 Mendenhall Pl., Jacksonville, FL (US) 32224

( * ) Notice: Subject to any disclaimer, the term of this patent is extended or adjusted under 35 U.S.C. 154(b) by 0 days.

(21) Appl. No.: 10/077,417

(22) Filed: Feb. 15, 2002

(51) Int. Cl.[7] ..... B65D 25/00
(52) U.S. Cl. ..... 220/560; 220/739
(58) Field of Search ..... 220/560, 737, 220/739, 903

(56) References Cited

U.S. PATENT DOCUMENTS 661,380 A * 11/1900 Mordan et al. ..... 220/628
2,531,562 A 11/1950 Eve
3,015,406 A 1/1962 Nolte
3,090,478 A 5/1963 Stanley
3,367,525 A * 2/1968 Elder ..... 220/560
3,533,529 A 10/1970 Helbig
3,831,209 A 8/1974 Clingman
4,887,716 A 12/1989 Abraham
4,927,041 A * 5/1990 Hepburn ..... 220/560
5,174,534 A 12/1992 Mitchell
5,279,452 A 1/1994 Huynh
5,447,764 A 9/1995 Langford
5,709,105 A 1/1998 Palermo
5,727,709 A 3/1998 Nobile
6,029,845 A 2/2000 Mueller
6,085,926 A * 7/2000 Weiss ..... 220/23.86
6,491,179 B2 * 12/2002 Dokun ..... 220/560
2002/0027141 A1 * 3/2002 Dokun ..... 220/560

* cited by examiner

*Primary Examiner*—Stephen Castellano
(74) *Attorney, Agent, or Firm*—Camoriano and Associates; Theresa Fritz Camoriano

(57) ABSTRACT

A floating beverage holder is shown which provides flotation and stability to a beverage container in the water. The holder includes a receptacle for receiving the beverage, a stabilizer for making the receptacle stable in the water to reduce the opportunity for tipping over, and flotation member, which may be movable relative to the receptacle.

20 Claims, 5 Drawing Sheets

FLOATING BEVERAGE HOLDER

BACKGROUND

While many types of beverage holders are known, it would be desirable to have a beverage holder that would float in a body of water, such as a swimming pool, spa, or lake, and maintain a beverage in an upright position in order to prevent the beverage from spilling or being contaminated.

SUMMARY OF THE INVENTION

The present invention provides a beverage holder that maintains a beverage in an upright position in a body of water. It includes a receptacle to hold the beverage, a flotation member to provide buoyancy, and a stabilizer which projects downwardly from the receptacle to prevent the beverage holder from tipping over.

DESCRIPTION OF THE PREFERRED EMBODIMENT

Figure 1:
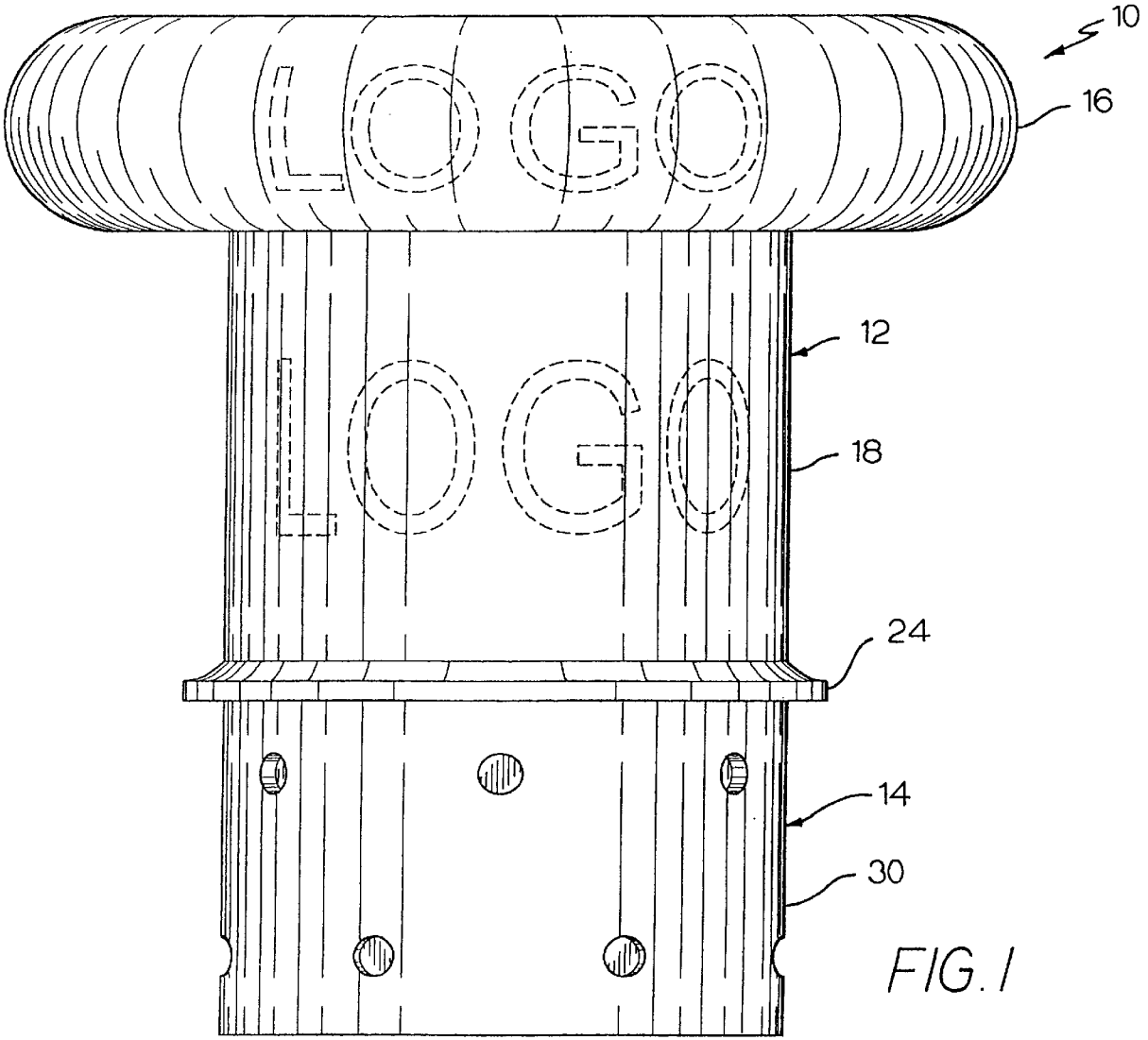
FIG. 1 is a front view of a beverage holder made in accordance with the present invention.
Figure 3:
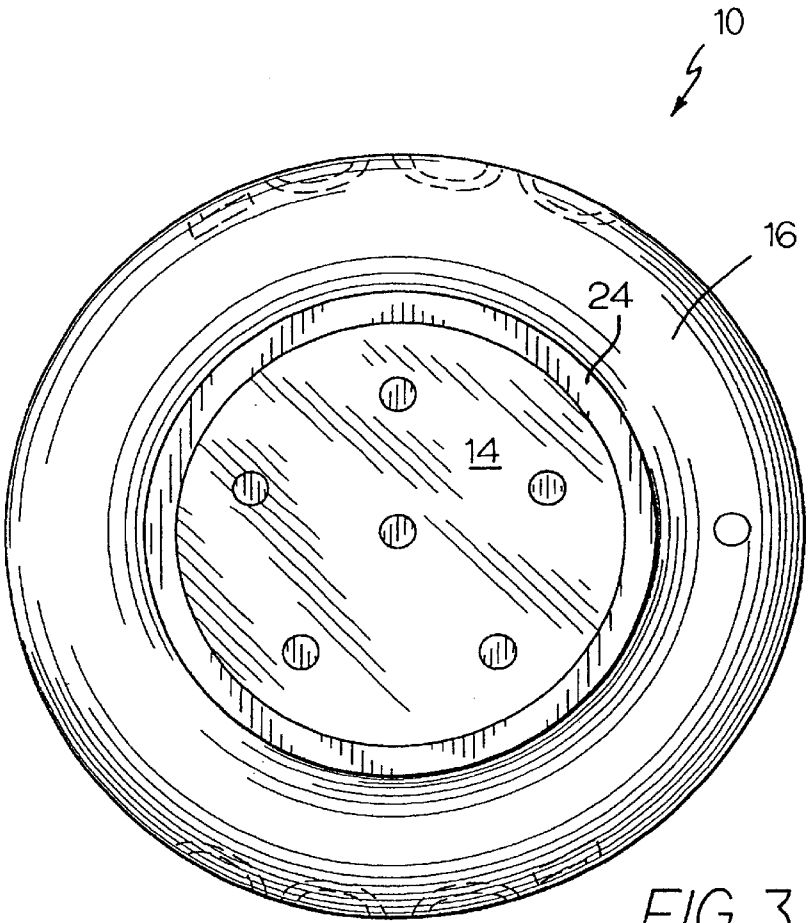
FIG. 3 is a bottom view of the beverage holder of FIG. 1.
Figure 2:
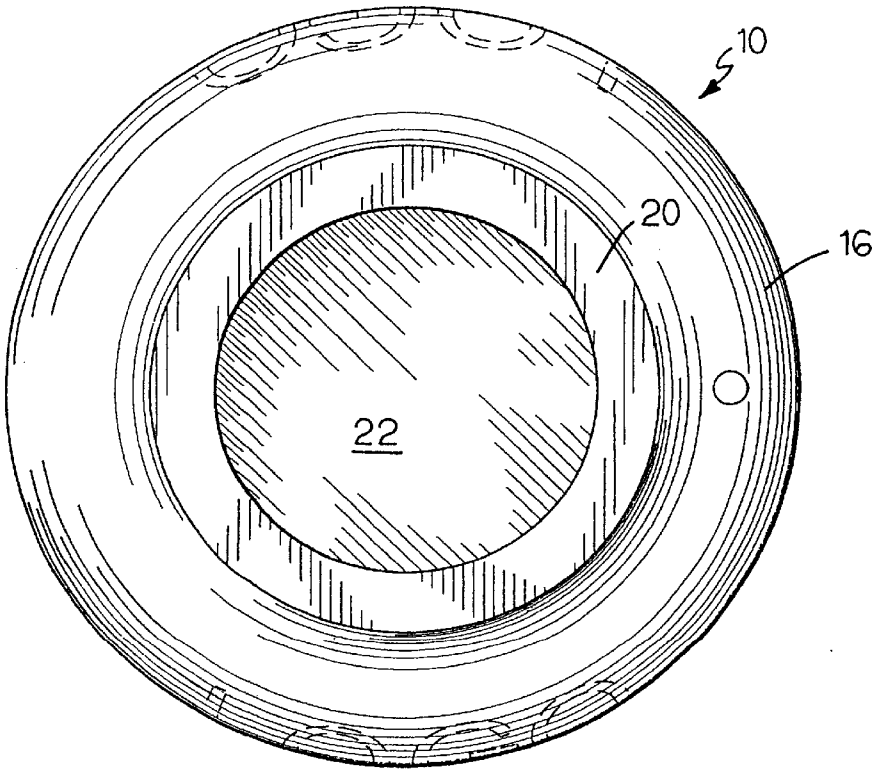
FIG. 2 is a top view of the beverage holder of FIG. 1.
Figure 4:
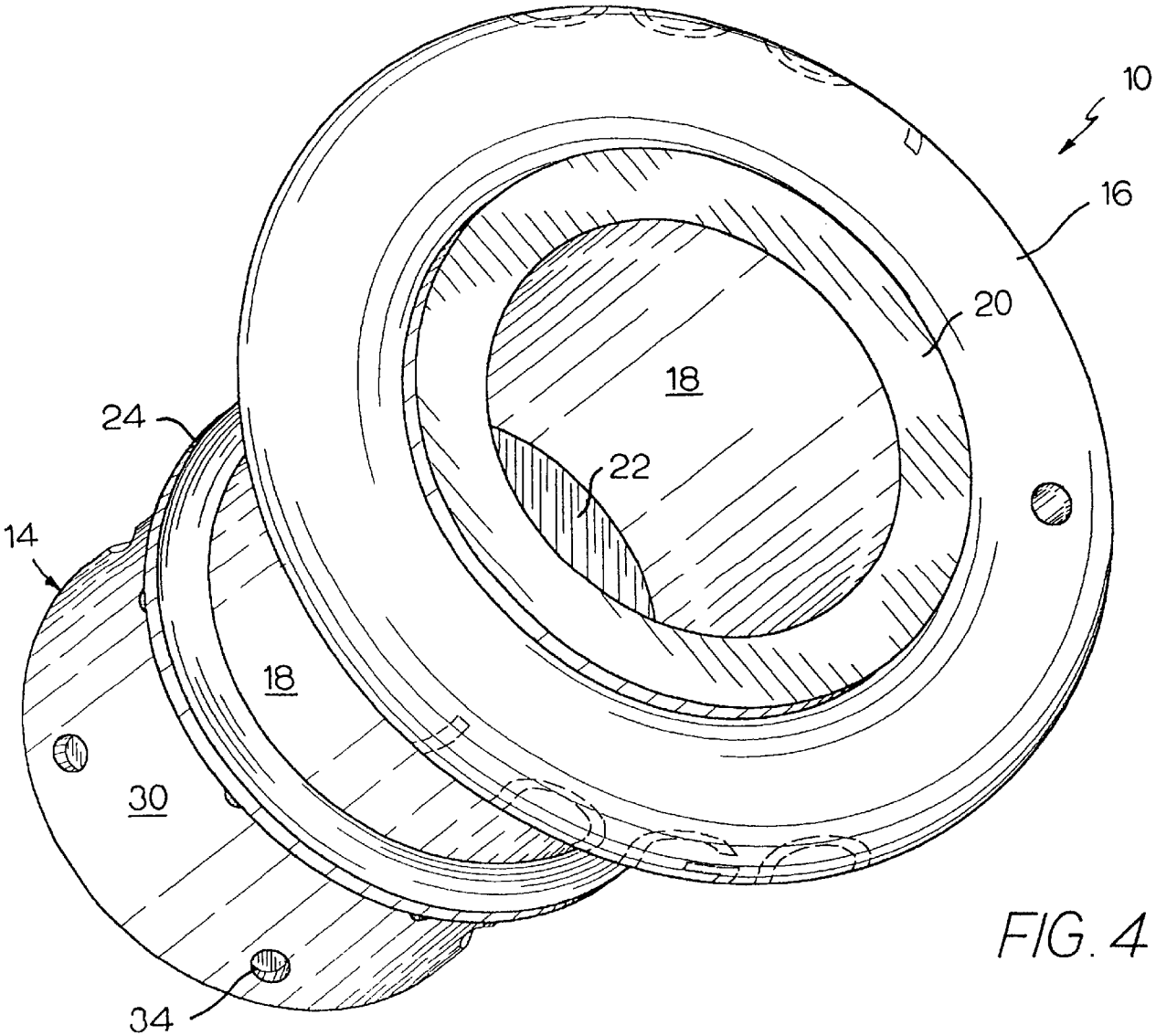
FIG. 4 is a top perspective view of the beverage holder of FIG. 1.
Figure 5:
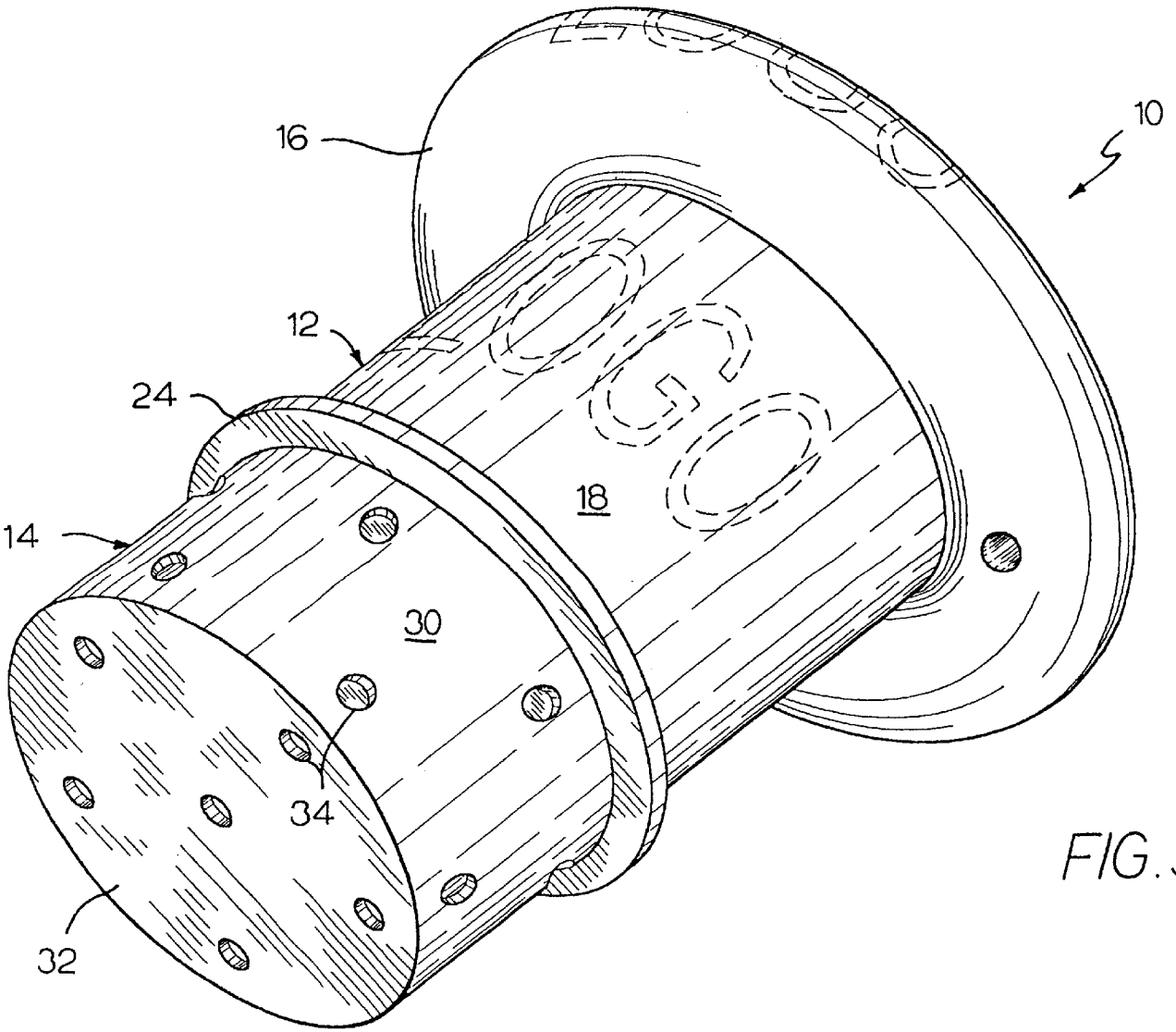
FIG. 5 is a bottom perspective view of the beverage holder of FIG. 1.

A first embodiment of a floating beverage holder 10 made in accordance with the present invention is shown in FIGS. 1–5. The beverage holder 10 includes a receptacle 12 for receiving a beverage container, a downwardly-projecting stabilizer 14, for keeping the holder upright in the water, and a flotation member 16, which provides buoyancy to keep the beverage and holder afloat.

The side wall 18 of the receptacle 12 is substantially cylindrical, defining a cylindrical inner surface and a cylindrical outer surface elongated in the vertical direction. The internal dimensions of the receptacle 12 preferably are sized to receive a standard-sized beverage can. At the top edge of the side wall 18 is an outwardly-projecting upper lip 20. The top of the cylindrical side wall 18 is completely open so as to permit the insertion of a beverage into the receptacle 12. A bottom wall 22 closes off the bottom of the receptacle 12, providing a water-tight enclosure at the bottom of the receptacle 12. A lower lip 24 projects outwardly from the outer surface of the receptacle side wall 18.

In this embodiment, the flotation member 16 is a ring, having an inside diameter that is less than the outside diameters of both the upper and lower lips 20, 24, so that the flotation ring is retained on the body of the beverage holder 10. This flotation ring 16 has a vertical height and is free to move up and down along the side wall 18 of the receptacle a distance at least equal to its own vertical height. In other words, the distance between the upper and lower lips 20, 24 is at least twice the vertical height of the flotation ring 16. The flotation ring 16 may be made of a foam material or may be a sealed solid outer shell with air inside (similar to an inner tube), or any other form that is lighter than the water it displaces in order to provide buoyancy to the beverage holder. When the ring 16 is providing the buoyancy to support the beverage holder in the water, it is in contact with the upper lip 20, as shown in these drawings, and applies an upward force to the upper lip 20.

While this flotation member 16 is a ring that is movable relative to the rest of the beverage holder, the flotation member 16 could alternatively be part of the receptacle itself or could otherwise be fixed to the receptacle, as in U.S. Pat. No. 5,727,709 "Nobile", which is hereby incorporated by reference. A movable flotation member 16 is, however, preferred, as it remains near the bottom of the receptacle 12 when it is not under a load and therefore does not raise the center of gravity of the beverage holder when it does not have a load to support. This permits it to remain in contact with the water, serving to make the beverage holder more stable in the water and less likely to tip over both when it is under load (supporting a beverage container) and when it is empty.

The stabilizer body 14 in this embodiment is also generally cylindrical in shape, having a side wall 30 with the same inside and outside diameters as the receptacle 12. The stabilizer body 14 also includes a bottom wall 32, but the bottom wall 32 preferably is open, in that it defines openings that permit water in. (One alternative to this embodiment would be for the bottom of the stabilizer body to be completely open, with no bottom wall at all.) The side wall 30 and bottom wall 32 define holes 34 through the walls 30, 32, which permit water into the interior of the stabilizer body 14. It is preferred that the height of the stabilizer 14 be at least one-fourth of the height of the receptacle 12, and it is most preferred that the height of the stabilizer 14 be at least one-third of the height of the receptacle 12 in order to provide good stability to the beverage holder 10.

In this embodiment, the flotation member 16 is made of a flexible foam material. In order to install the flotation member 16 on the beverage holder 10, it is slid upwardly from the bottom of the stabilizer 14, and it is stretched enough to pass over the lower lip 24 and is then released. At that point, it is retained on the beverage holder 10 and is free to move up and down between the upper and lower lips 20, 24.

To use the beverage holder 10, it is inserted into a body of water, such as a swimming pool, and the stabilizer 14 fills with water. Then, a can, bottle, glass, or other beverage container is inserted into the receptacle 12, preferably until it contacts the bottom wall 22 of the receptacle 12 and rests on that bottom wall 22. The beverage holder 10 sinks, moving downwardly relative to the flotation member 16 until the flotation member 16 contacts the bottom of the upper lip 20, and then the flotation member 16 supports the beverage holder on the surface of the water. The beverage holder 10 will thereafter provide sufficient buoyancy to continue supporting the beverage and will provide sufficient stability to prevent the beverage from tipping over.

Figure 6:
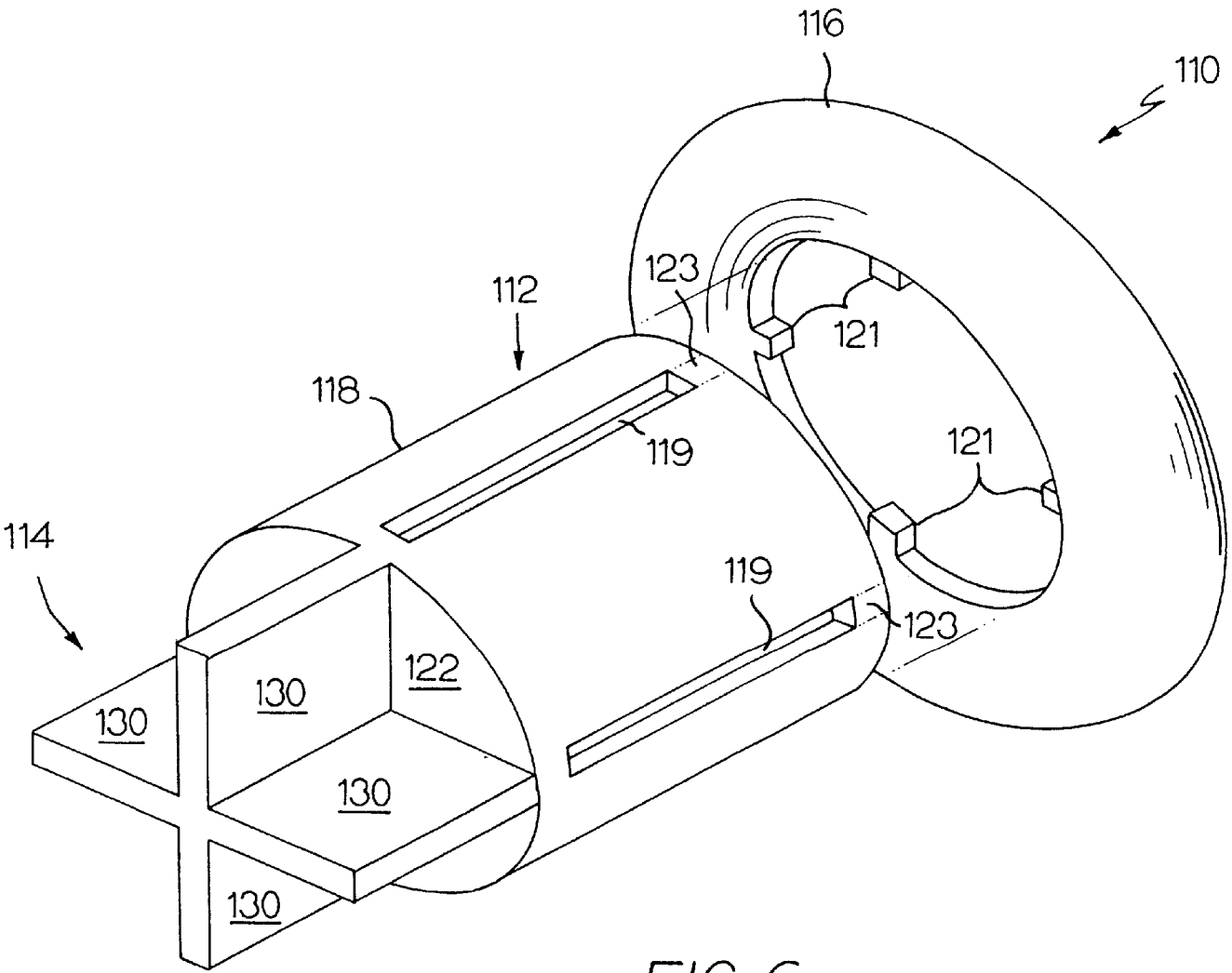
FIG. 6 is a bottom perspective view of an alternative embodiment of a beverage holder made in accordance with the present invention.

FIG. 6 shows an alternative embodiment of a floating beverage holder 110 made in accordance with the present invention. In this case, there is a movable flotation member 116, a receptacle 112 with a side wall 118 and a bottom wall 122, and a stabilizer 130 with downwardly-projecting walls 130. The receptacle 112 again is substantially cylindrical and defines a central vertical axis. As with the previous embodiment, the height of the stabilizer walls 130 is preferably at least one-fourth of the height of the receptacle 112 and most preferably at least one-third of the height of the receptacle. In this case, the stabilizer walls 130 preferably do not define holes, although they could still function with holes. The stabilizer walls 130 are shown here radiating from the central axis of the receptacle at right angles, but the number of walls 130, the angles between the walls, and the position of the walls 130 relative to the center of the bottom wall 122 could be varied. Of course, the shape of the receptacle 112 also need not be cylindrical, but it is preferred that the stabilizer and the receptacle be symmetrical about the central axis.

The outer surface of the side wall 118 defines grooves 119, and the inner surface of the flotation member 116 defines inwardly-projecting teeth 121, which ride up and down in the grooves 119. At the top edge of the grooves 119 are stops 123, against which the teeth 121 bear in order to lift the receptacle 112 to maintain its buoyancy in the water.

In order to install the flotation member 116 on the receptacle 112, a variety of manufacturing methods may be used. For example, the teeth 121 may be deformed enough during installation to jump over the upper stop portions 123 of the receptacle and then return to their normal positions in order to remain in the grooves 119 during normal operation, or the grooves 119 may extend all the way to the top edge of the receptacle 112, and the stop portions 123 may be installed after the teeth 121 of the flotation member 116 are inserted into the grooves 119. The flotation member 116 could be made in two parts that are joined after the teeth 121 are installed in their grooves 119, and so forth.

While two embodiments of the present invention are shown here, these are intended only as examples. It will be obvious to those skilled in the art that various modifications could be made to those examples without departing from the scope of the present invention.

What is claimed is:

1. A floating beverage holder, comprising:

a receptacle body including a receptacle side wall having a top edge and a bottom and defining a substantially cylindrical interior surface elongated in the vertical direction and sized to receive a beverage container; and a bottom wall closing the bottom of said receptacle body;

a flotation member retained on said receptacle body, said flotation member having a vertical height, being buoyant in water and providing sufficient buoyancy to cause said receptacle body to float in water when a full beverage container is received in said receptacle body;

means for retaining said flotation member on said receptacle body, said means permitting said flotation member to move up and down relative to said receptacle body a distance at least equal to the vertical height of the flotation member while said flotation member is retained on said receptacle body; and a stabilizer body projecting downwardly from said receptacle body, said stabilizer body extending below said bottom wall a distance which is at least one-fourth of the distance from said bottom wall to said top edge.

2. A floating beverage holder as recited in claim 1, wherein said bottom wall provides a water-tight closure.

3. A floating beverage holder as recited in claim 1, wherein said stabilizer body includes a tubular wall defining a plurality of openings through said tubular wall.

4. A floating beverage holder as recited in claim 3, wherein said tubular wall has substantially the same inside and outside diameters as said receptacle body.

5. A floating beverage holder as recited in claim 1, wherein said flotation member is a ring surrounding said receptacle body.

6. A floating beverage holder as recited in claim 5, wherein said means for retaining said flotation member on said receptacle body includes an outwardly projecting upper lip on said receptacle body and an outwardly projecting lower lip on one of said substantially cylindrical body and said stabilizer body, wherein the inside diameter of said flotation ring is smaller than said upper and lower lips, so that said upper and lower lips retain the flotation ring on said beverage holder.

7. A floating beverage holder as recited in claim 1, wherein said stabilizer body includes first and second intersecting walls.

8. A floating beverage holder as recited in claim 7, wherein said first and second intersecting walls lie at substantially right angles to each other.

9. A floating beverage holder as recited in claim 1, wherein said means for retaining said flotation member includes an outwardly projecting upper lip on said receptacle body and an outwardly projecting lower lip on one of said receptacle body and said stabilizer body, wherein said flotation member is located between said upper and lower lips and has an inside diameter that is smaller than said upper and lower lips.

10. A floating beverage holder as recited in claim 1, wherein said means for retaining said flotation member includes said flotation member having an inwardly-projecting tooth and said receptacle defining a groove that receives said tooth.

11. A floating beverage holder as recited in claim 10, and further comprising a plurality of inwardly-projecting teeth on said flotation member and a plurality of grooves on said receptacle which receive said teeth.

12. A floating beverage holder, comprising:

a receptacle for receiving a beverage, said receptacle including a side wall and a bottom wall and being elongated in the vertical direction;

a flotation member that is buoyant in water and that supports said receptacle when the receptacle is placed in the water, said flotation member having a vertical height;

means for retaining said flotation member on said receptacle, said means permitting said receptacle to move up and down relative to said receptacle a distance at least equal to the vertical height of the flotation member while said flotation member is retained on said receptacle; and a stabilizer body projecting downwardly from said receptacle a distance of at least one-fourth the height of said receptacle to provide stability to said receptacle to reduce the possibility of its falling over when placed in the water.

13. A floating beverage holder as recited in claims 12, wherein said stabilizer body is tubular.

14. A floating beverage holder as recited in claim 13, wherein said stabilizer body defines a plurality of openings.

15. A floating beverage holder as recited in claim 12, wherein said stabilizer body includes a plurality of downwardly-projecting walls.

16. A floating beverage holder as recited in claim 15, wherein said downwardly-projecting walls intersect.

17. A floating beverage holder as recited in claim 16, wherein said receptacle defines a central axis, and said downwardly-projecting walls intersect along said central axis.

18. A floating beverage holder as recited in claim 12, wherein said means for retaining said flotation member includes said receptacle and said stabilizer body together defining outwardly-projecting upper and lower lips, and said flotation member having an inside diameter smaller than the outside diameters of said upper and lower lips and being located between said upper and lower lips.

19. A floating beverage holder as recited in claim 17, wherein said means for retaining said flotation member on said receptacle includes said flotation member having a projecting tooth and said receptacle defining a groove which receives said tooth.

20. A floating beverage holder as recited in claim 12, wherein said means for retaining said flotation member comprises an outwardly projecting upper lip on said receptacle and an outwardly projecting lower-lip on one of said receptacle and said stabilizer body, wherein said flotation member has an inside diameter that is smaller than said upper and lower lips and said flotation member is trapped between said upper and lower lips.

* * * * *